US006572208B2

(12) United States Patent
Albaizar et al.

(10) Patent No.: US 6,572,208 B2
(45) Date of Patent: Jun. 3, 2003

(54) CLOTHES DRYING, DEWRINKLING AND IRONING CABINET

(75) Inventors: Alberto Albaizar, Mondragon (ES); Luis Javier Arrieta, Mondragon (ES)

(73) Assignee: Fagor, S. Coop., Mondragon (ES)

( * ) Notice: Subject to any disclaimer, the term of this patent is extended or adjusted under 35 U.S.C. 154(b) by 0 days.

(21) Appl. No.: 10/154,215

(22) Filed: May 22, 2002

(65) Prior Publication Data

US 2002/0195914 A1 Dec. 26, 2002

Related U.S. Application Data

(63) Continuation-in-part of application No. 09/791,458, filed on Feb. 22, 2001, now abandoned.

(30) Foreign Application Priority Data

May 30, 2000 (ES) ..... 200001365

(51) Int. Cl.[7] ..... A47B 77/10

(52) U.S. Cl. ..... 312/314; 312/317.3; 108/42

(58) Field of Search ..... 312/236, 313, 312/314, 315, 316, 317.1, 317.2, 317.3, 321.5, 237, 319.1, 319.2, 319.3; 108/42, 43

(56) References Cited

U.S. PATENT DOCUMENTS

| | | | | | |
|---|---|---|---|---|---|
| 1,994,044 | A | * | 3/1935 | Michelet | 312/313 X |
| 2,548,437 | A | * | 4/1951 | Mantagas | 312/317.2 X |
| 3,126,236 | A | * | 3/1964 | Buchan et al. | 312/313 X |
| 3,742,868 | A | * | 7/1973 | Garceau et al. | 108/39 |
| 4,155,609 | A | * | 5/1979 | Skafte et al. | 312/314 X |
| 4,995,681 | A | * | 2/1991 | Parnell | 312/242 |
| 5,329,860 | A | * | 7/1994 | Mattesky | 108/42 X |
| 5,695,264 | A | * | 12/1997 | Koch | 312/314 X |
| 5,775,034 | A | * | 7/1998 | Logue | 312/314 X |
| 5,778,573 | A | * | 7/1998 | Nottingham et al. | 108/42 X |

FOREIGN PATENT DOCUMENTS

| | | | | |
|---|---|---|---|---|
| FR | 1199842 | * | 12/1959 | 312/314 |
| FR | 1238318 | * | 7/1960 | 312/317.3 |

* cited by examiner

*Primary Examiner*—James O. Hansen
(74) *Attorney, Agent, or Firm*—The Kline Law Firm

(57) ABSTRACT

A clothes drying, dewrinkling and ironing cabinet comprising a main enclosure (2) for housing clothes, access to said main enclosure (2) being by way of a door (3), and means for drying and dewrinkling the clothes in said enclosure (2), said cabinet also having an ironing board unit (4). This ironing board unit (4) is a folding one and is mounted on the inside of the door (3)

5 Claims, 6 Drawing Sheets

CLOTHES DRYING, DEWRINKLING AND IRONING CABINET

This application is a continuation-in-part of U.S. application Ser. No. 09/791,458, filed Feb. 22, 2001, now abandoned, and claims priority of Spanish application ES-P200001365, filed May 30, 2000.

TECHNICAL FIELD

The present invention relates to clothes drying, dewrinkling and ironing systems, and more specifically to clothes drying, dewrinkling and ironing cabinets intended mainly for domestic use, as well as to devices relating to conventional ironing.

PRIOR ART

It is a proven fact that one of the most disagreeable household chores is the process that initiates when clean clothes (garments, sheets, etc.) are taken out of the washing machine and finishes when they are stowed away in the respective wardrobe duly ironed. This process includes such operations as hanging out the washing taken out of the washing machine, bringing it in when dry, organizing the ironing thereof, etc.

There have been many attempts to expedite and simplify this process, but no household domestic appliance has been developed to date offering a complete and final solution.

EP1146162 discloses a cabinet for clothes drying and dewrinkling, as well as a method for carrying out said drying and dewrinkling. Said invention facilitates the task of ironing to a considerable extent, as the level of dewrinkling that is achieved is such that subsequent use of the iron is only necessary for a small number of garments and for only very localized parts thereof.

The fact however that it is still necessary to resort to conventional ironing (even though it is only for a few garments) means that the user cannot dispense with the ironing board and cannot avoid the problems stemming from the need to use the iron (take the ironing board out of the place where it is stored, set it up in a suitable place, take it down and stow it away again after use, etc.).

There are a wide variety of ironing board units. U.S. Pat. No. 4,995,681 describes a folding ironing board that is kept in a purpose built cabinet for its storage.

U.S. Pat. No. 5,329,860 discloses an ironing board unit that can be mounted on a door. The invention includes an upright member with a hook that is hung from the frame of the chosen door, a transverse member fixed to said upright member, an ironing board hingedly attached to said transverse member, and a leg hingedly attached to said ironing board.

DISCLOSURE OF THE INVENTION

The main object of the invention is to provide a household appliance that offers a complete, global and integrated solution to the domestic chore that commences when clean clothes are taken out of the washing machine and concludes when they are duly ironed and stowed away.

Said household appliance is a clothes drying, dewrinkling and ironing cabinet that comprises a main enclosure for housing clothes, with access to said main enclosure by way of a door, means for drying and dewrinkling said clothes in said enclosure, and an ironing board unit. This ironing board unit is a folding one and is mounted on the inside face of the cabinet door.

In this way, once the cabinet drying and dewrinkling program is concluded, the user has the possibility of opening said cabinet, setting up the ironing board unit housed on the inside face of the cabinet door and ironing those garments that are considered to need pressing.

This means that the user of this invention:

Versus the user of an ironing board with a collapsible underframe, has the advantage of not having to take the ironing board unit out of the place where it is stored and set it up in a suitable place, nor of having to take it back to its place again once ironing is completed.

Versus the user of a fold-down ironing board in respect of a fixed support, has the advantage of not having to take the clothes from the drying and dewrinkling cabinet to the place where the folding board unit is located.

Furthermore, since the invention makes it possible for the ironing board not to have to be kept somewhere else in the house (it is inside the drying and dewrinkling cabinet), it also affords a saving in time and effort as well as saving space.

Apart from the ironing board unit, the rest of the equipment needed for ironing, such as the actual iron itself, will also be kept in the drying and dewrinkling cabinet.

Another object of the invention is to provide the cabinet covered by the invention with an ironing board unit that comprises a board that is automatically placed in a predetermined height when the user folds it down.

The ironing board unit of the invention comprises:

a board;

a support movably connected to the inside of the door, one end of said board being hingedly connected to said support;

a leg hingedly connected to the under side of said board; and pushing means for displacing said support upwards while said board is being folded down.

The pushing means make force upwards against the support. When the board is folded away, said force is balanced by way of the weight of the support and the board. When the user begins to fold the board down, the gravity center of the board is displaced from the end that is hingedly connected to the support towards the opposite end. So, as the force of the pushing means becomes bigger than the weight that the pushing means are bearing, said pushing means displace the support upwards. Thus, the end of the board that is hingedly connected to the support (and the support itself) is higher when the board is folded down than when the board is folded up. When the board is folded away by the user, the weight of said board overcomes the force of the pushing means and said board is placed back in its original position.

Considering that 0.90 m is a standard height for the board when it is in its working position and that a standard length for an ironing board is 1.20 m, if there was not an upwards displacement while folding the board down, the door of the cabinet should be higher than 2.10 m in order to store the board when folded away. With the ironing board unit of the invention, the door of the cabinet and the cabinet itself do not have to be so high, and said ironing board unit can be adapted to cabinets of different height.

The ironing board unit of the invention further comprises fixing means for fixing the support in a predetermined height while the user is folding the board down. In this way, said fixing means will make said support stop in said predetermined height when said board is being folded down. Said predetermined height may be previously adjustable by the user.

DETAILED DISCLOSURE OF AN EMBODIMENT OF THE INVENTION

Figure 1:
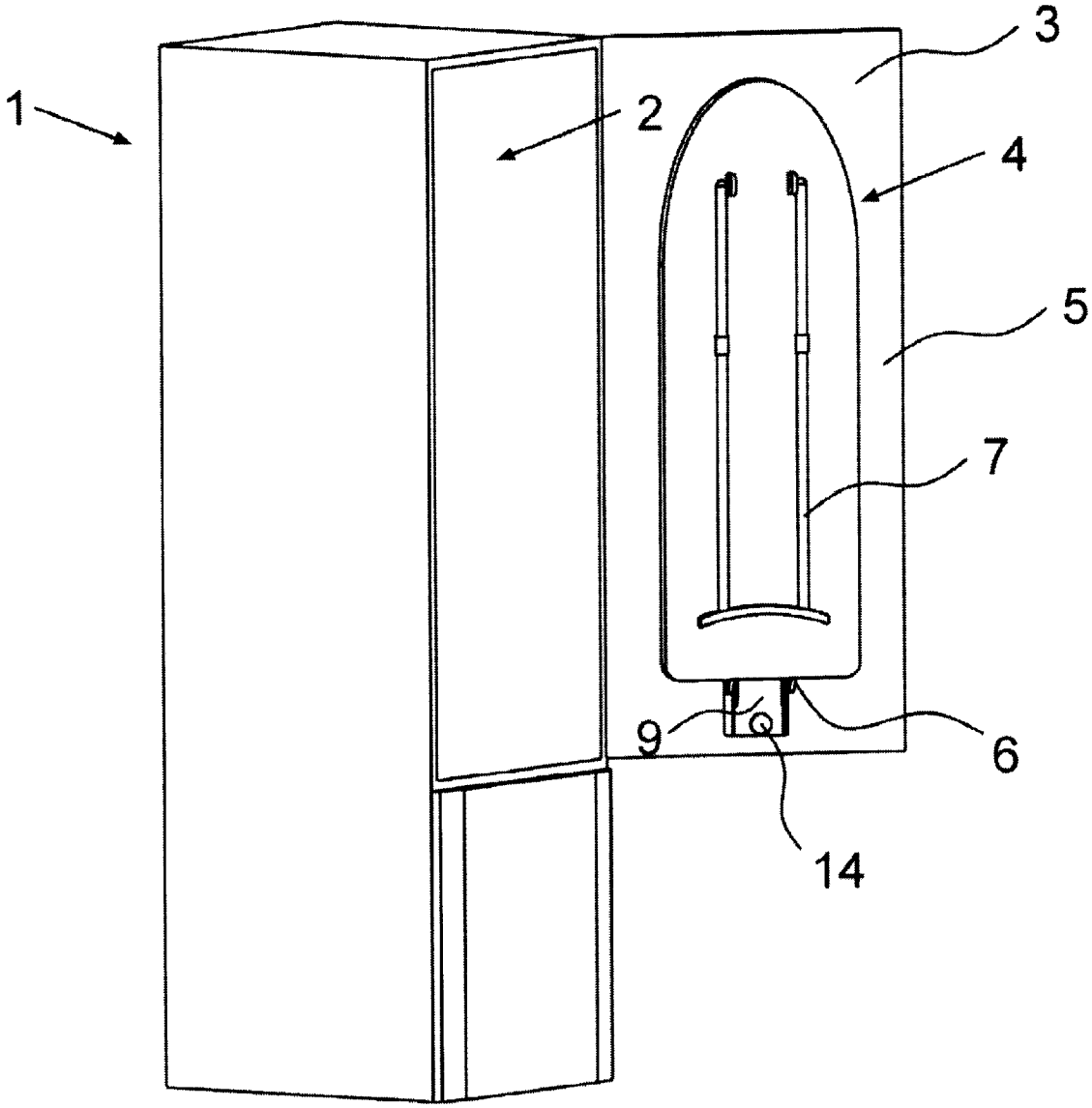
FIG. 1 is a perspective view of an embodiment of the cabinet of the invention with the ironing board folded away.
Figure 2:
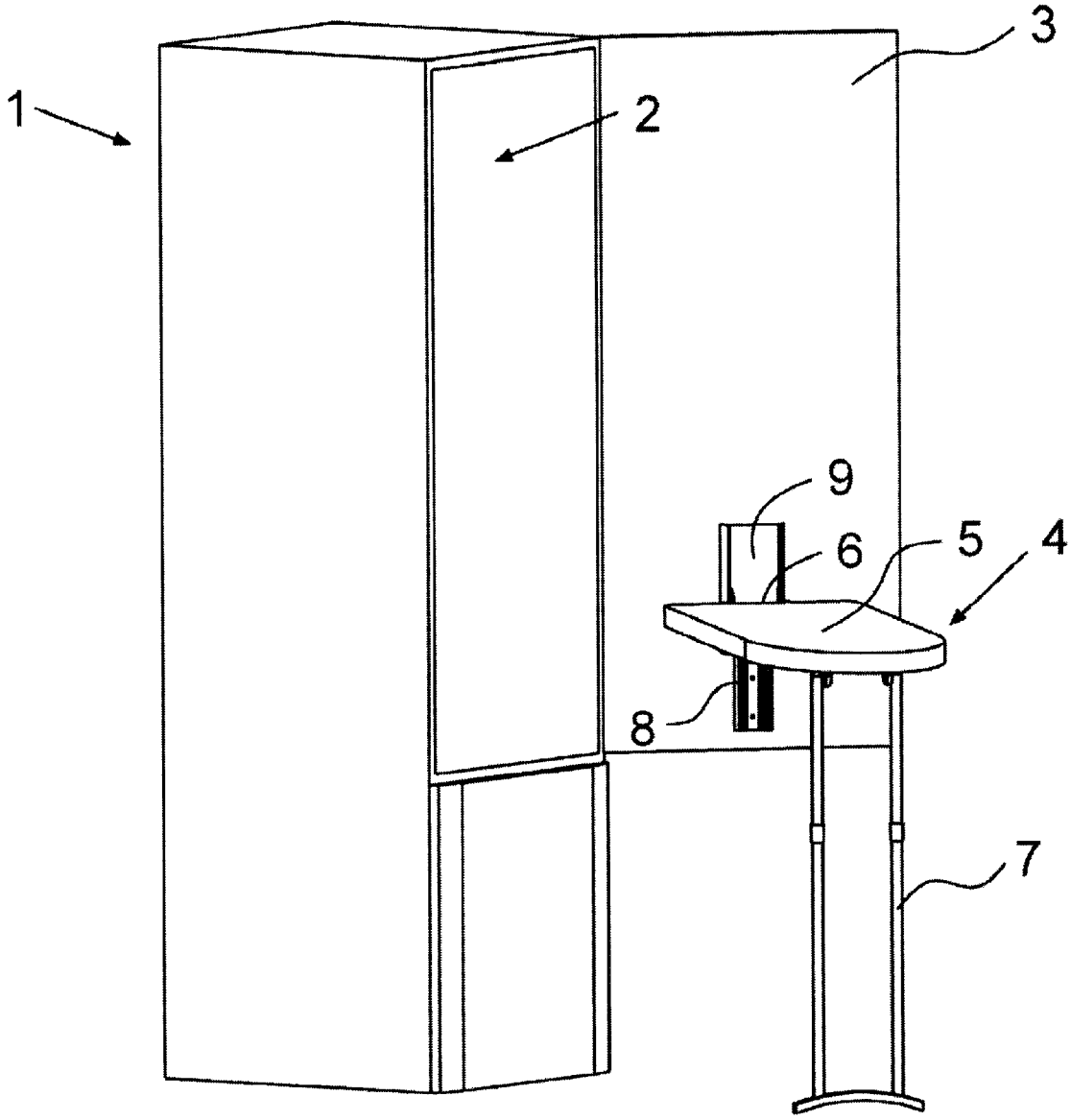
FIG. 2 is a perspective view of the embodiment of FIG. 1 with the ironing board folded down.

Referring to FIGS. 1 and 2, the cabinet 1 of the invention comprises:

a main enclosure 2 for housing clothes;

a front door 3 offering access to said main enclosure 2;

means (not shown) for drying and dewrinkling said clothes in the enclosure 2;

an ironing board unit 4 placed on the inner side of the door 3.

The means for drying and dewrinkling the clothes may include, for example, means for supplying air to said main enclosure 2, means for supplying steam to said main enclosure 2 and control means for regulating said air delivery means and said steam delivery means. The cabinet 1 will also include the necessary equipment (not shown in the figures) for carrying out conventional ironing, such as the actual iron itself.

The ironing board unit 4 comprises a board 5, a support 9 movably connected to the inside of the door 3, one end 6 of said board 5 being hingedly connected to said support 9, a leg 7 hingedly connected to the under side of said board 5, and pushing means for displacing said support 9 upwards while said board 5 is being folded down.

Figure 5:
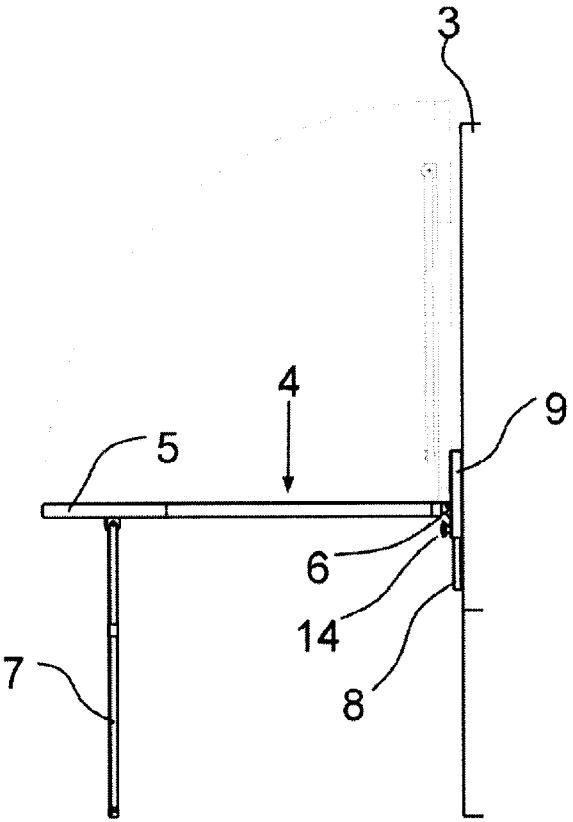
FIG. 5 is a profile view of the embodiment of the ironing board unit of FIG. 3, the board of said unit being folded down.
Figure 4:
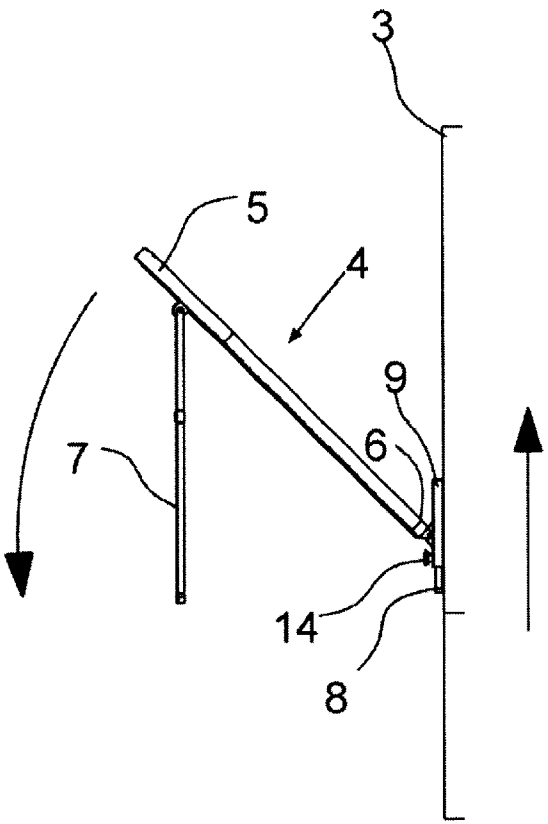
FIG. 4 is a profile view of the embodiment of the ironing board unit of FIG. 3, the board of said unit being in an intermediate position.
Figure 3:
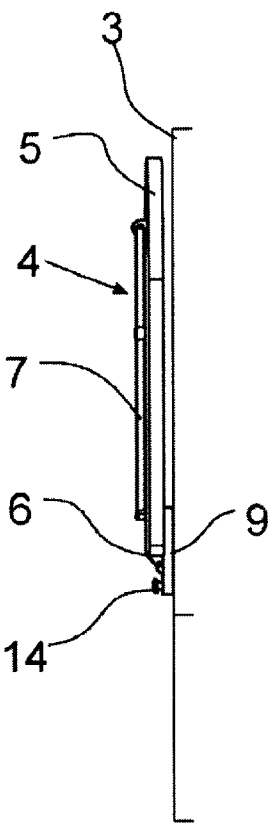
FIG. 3 is a profile view of an embodiment of the ironing board unit of the invention, the board of said unit being folded away.

As the support 9 is vertically displaced by the pushing means when the board 5 is being folded down, the end 6 of the board 5 (the one that is hingedly connected to the support 9) is higher when the board 5 is folded down than when the board 5 is folded away. FIGS. 3, 4 and 5 show the board 5 in three different positions: folded away, in an intermediate position when it is being folding down, and folded down.

The pushing means make force upwards against the support 9. When the board 5 is folded away, said force is balanced by way of the weight of the support 9 and the board 5, said support 9 and said board 5 being placed as shown in FIG. 3. When the user begins to fold the board 5 down, the gravity center of said board 5 is displaced from the end 6 towards the opposite end. The displacement of said gravity center is produced by the combined effect of the displacement of the board 5 itself and the turning of the leg 7. So, as the force of the pushing means becomes bigger than the weight that the pushing means are bearing, said pushing means displace the support 9 upwards.

When the board is folded away by the user, the weight of said board overcomes the force of the pushing means, so there is a vertical displacement of the support 9 and the board 5 and said board 5 is placed back in its original position. As can be seen in FIG. 3, if there was not a vertical displacement of the support 9, the board 5 would protrude from the upper part of the door 3.

The ironing board unit 4 further comprises fixing means for fixing said support 9 in a predetermined height while said board 5 is being folded down. Said fixing means make said support 9 stop in said predetermined height when said board 5 is being folded down. Said fixing means will have to be released before folding away the board 5.

Figure 6:
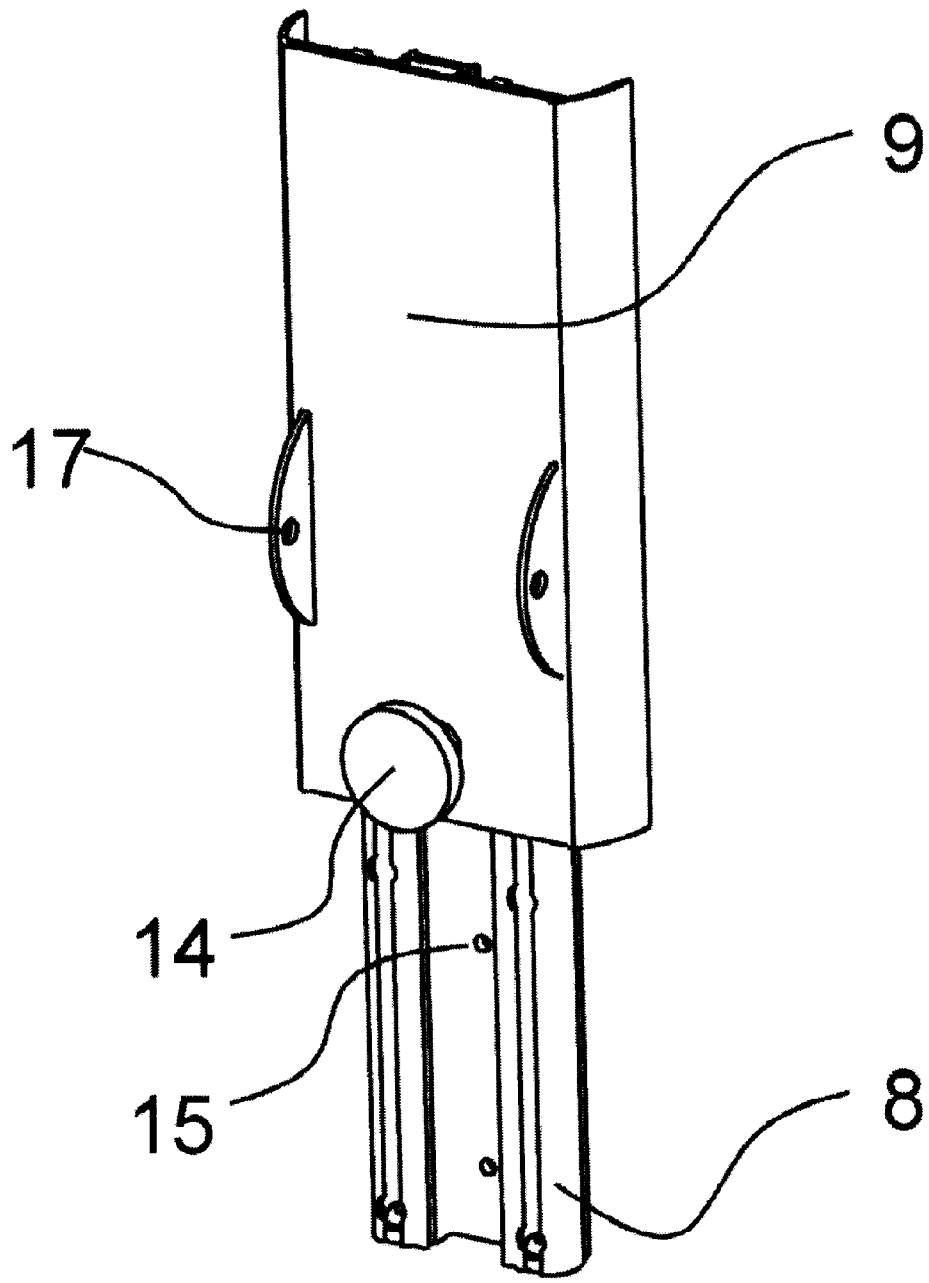
FIG. 6 is a perspective view of the support and the base of the embodiment of FIG. 1.
Figure 7:
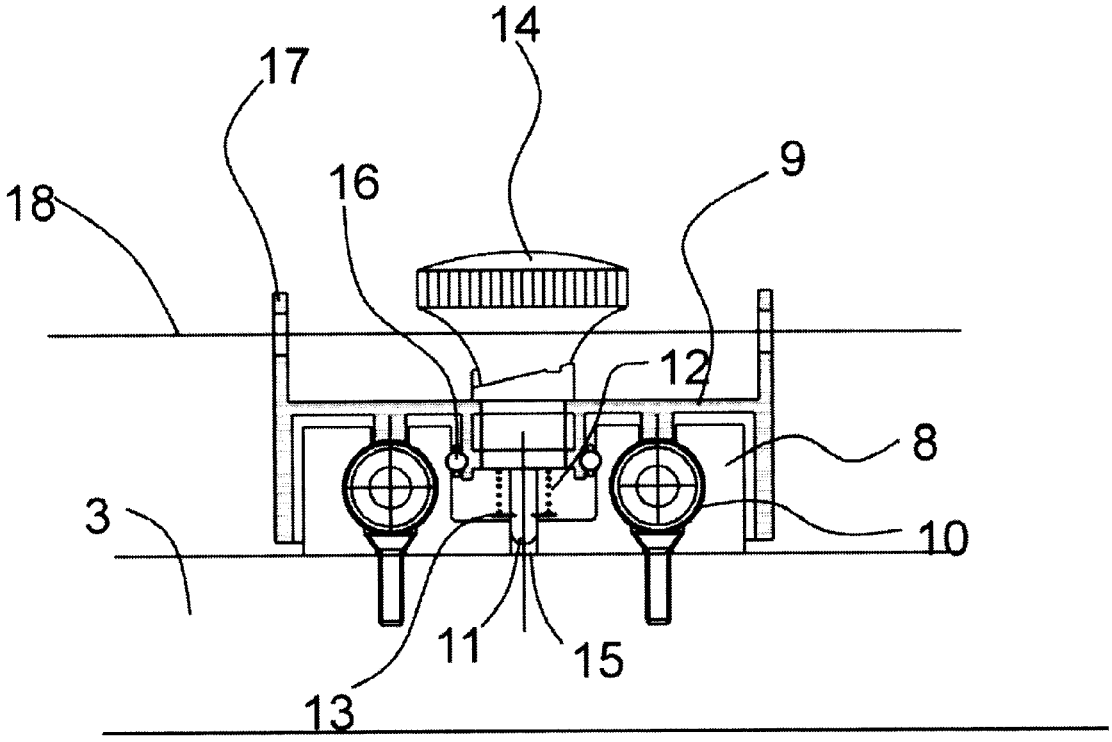
FIG. 7 is a cross section of the support and the base of the embodiment of FIG. 1.
Figure 8:
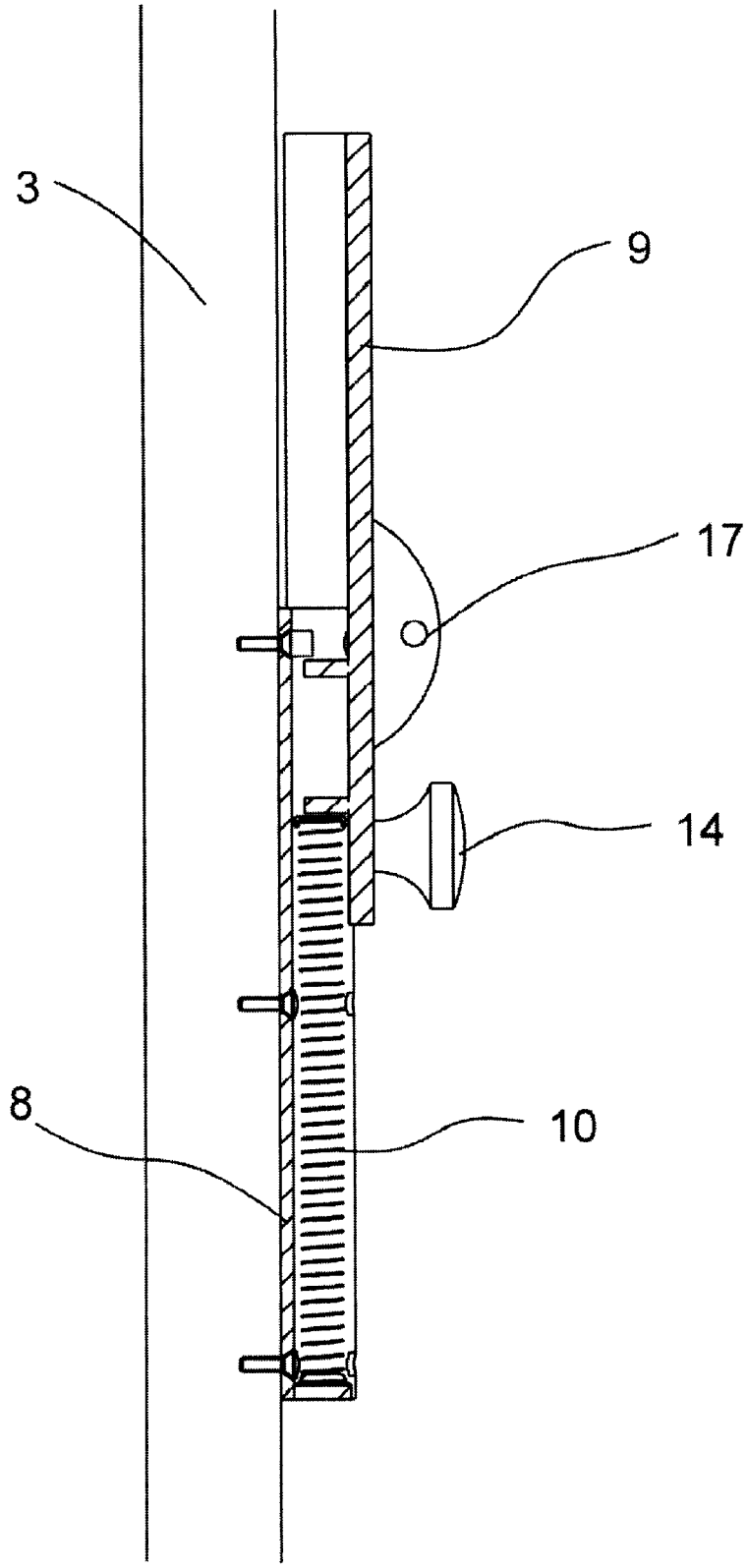
FIG. 8 is a profile section of the support and the base of the embodiment of FIG. 1.

Referring now to FIGS. 6, 7 and 8, the support 9 is slidably connected to a base 8 that is fixed to the inside of the door 3. The pushing means are located in said base 8 and comprise, in this embodiment, two springs 10. The ironing board unit 4 also comprises sliding bushings 16 between the base 8 and the support 9. The support 9 includes two wings 17 that house an axis 18, the board 5 being connected to said axis 18.

The fixing means comprise a pin 11 located in the support 9 and means for pressing said pin 11 against the base 8. Said means for pressing comprise a spring 12 and a washer 13 fixed to said pin 11. The base 8 comprises a hole 15 in a predetermined height. When the user is folding down the board 5 and the support 9 is moving upwards, the pin 11 is inserted in said hole 15, stopping the support 9 in said predetermined height.

Said predetermined height is adjustable. In this embodiment, said height is adjusted through the selection by the user of one of a plurality of holes 15, all of them placed in different heights. For selecting one height, the user only has to choose the hole 15 corresponding to said height and close the other holes 15. Obviously, the length of the leg 7 is also adjustable so that it can be made to match the height that has been selected by the user.

The fixing means also comprise a knob 14 coaxial with said pin 11. When the board 5 is folded down, the user, before folding it away, only has to turn said knob 14 for extracting the pin 11 from the hole 15.

It will be apparent for the skilled in the art that many modifications could be introduced to the embodiment described getting to different embodiments that still would fall within the scope of the invention.

What is claimed is:

1. A folding ironing board unit mounting on the inside of a door of a cabinet, said ironing board unit comprising:

a board, a support movably connected to the inside of the cabinet door, one end of said board being pivotally connected to said support, a leg pivotally connected to an underside of said board, a base fixed to the inside of the door, said support being slidably connected to said base, and pushing means for displacing said support upward along said base while said board is being moved from an at rest position to a deployed position; wherein said pushing means causes said support to be at a higher position when said board is in said deployed position than when said board is in said at rest position.

2. The ironing board unit of claim 1, wherein:

said pushing means comprises at least one spring located in said base.

3. The ironing board unit of claim 1 wherein:

said ironing board unit comprises a fixing means for fixing said support at a predetermined height when said board is in said deployed position.

4. The ironing board unit of claim 3 wherein:

said fixing means comprises a pin located in said support, said pin being urged toward said base, said base having at least one hole at a predetermined height, said hole receiving said pin when said board is moved to said deployed position.

5. The ironing board unit of claim 4, wherein:

said predetermined height is adjustable.

* * * * *